US007623020B2

(12) United States Patent
Koyama

(10) Patent No.: US 7,623,020 B2
(45) Date of Patent: Nov. 24, 2009

(54) MULTILAYER CERAMIC ELECTRONIC COMPONENT

(75) Inventor: Kazushige Koyama, Hokkaido (JP)

(73) Assignee: Panasonic Corporation, Osaka (JP)

( * ) Notice: Subject to any disclaimer, the term of this patent is extended or adjusted under 35 U.S.C. 154(b) by 302 days.

(21) Appl. No.: 11/815,465

(22) PCT Filed: Feb. 28, 2006

(86) PCT No.: PCT/JP2006/303662

§ 371 (c)(1),
(2), (4) Date: Aug. 3, 2007

(87) PCT Pub. No.: WO2006/095597

PCT Pub. Date: Sep. 14, 2006

(65) Prior Publication Data

US 2009/0021340 A1 Jan. 22, 2009

(30) Foreign Application Priority Data

Mar. 11, 2005 (JP) ..... 2005-069083

(51) Int. Cl.
*H01C 7/10* (2006.01)

(52) U.S. Cl. ..... 338/21; 338/20; 361/307; 361/309

(58) Field of Classification Search ..... 338/20, 338/21, 332, 313, 314, 325; 361/307, 308, 361/309, 311

See application file for complete search history.

(56) References Cited

U.S. PATENT DOCUMENTS

| | | | | |
|---|---|---|---|---|
| 5,870,273 | A * | 2/1999 | Sogabe et al. | 361/306.3 |
| 6,160,472 | A * | 12/2000 | Arashi et al. | 338/21 |
| 6,400,253 | B1 * | 6/2002 | Jinno et al. | 338/332 |
| 6,535,105 | B2 * | 3/2003 | Heistand et al. | 338/226 |
| 7,012,501 | B2 * | 3/2006 | Krumphals et al. | 338/21 |

FOREIGN PATENT DOCUMENTS

| | | |
|---|---|---|
| JP | 60-60702 | 4/1985 |
| JP | 11-003809 | 1/1999 |
| JP | 2002-252105 | 9/2002 |
| JP | 2005-051052 | 2/2005 |

* cited by examiner

*Primary Examiner*—Kyung Lee
(74) *Attorney, Agent, or Firm*—Pearne & Gordon LLP

(57) ABSTRACT

A multilayer ceramic electronic component includes a multilayer body, a first internal electrode provided in the multilayer body, and a second internal electrode provided in the multilayer body and facing the first internal electrode. The multilayer body includes a first ceramic layer, a second ceramic layer provided on a first surface of the first ceramic layer, and a third ceramic layer provided on a second surface of the first ceramic layer opposite to the first surface. The first and second internal electrodes are connected to the first ceramic layer. The first ceramic layer contains mainly ZnO and 0 to 15 mol % of $SiO_2$. The second ceramic layer contains mainly ZnO and 15 to 50 mol % of $SiO_2$. The third ceramic layer contains mainly ZnO and 15 to 50 mol % of $SiO_2$; The multilayer ceramic component has a low varistor voltage and a small capacitance.

8 Claims, 4 Drawing Sheets

Fig. 6

| Sample No. | Ceramic Layer 13 | | Ceramic Layer 14, 114 | | Thickness Of Film 16 (μm) | Capaci-tance (pF) | Varistor Voltage ($V_{1mA}$/mm) | Voltage Non-Linear Coefficient α |
|---|---|---|---|---|---|---|---|---|
| | Concentration of $SiO_2$ (mol%) | Thickness WA (μm) | Concentration of $SiO_2$ (mol%) | Thickness WB+WC (μm) | | | | |
| 1 | 10 | 80 | 10 | 700 | - | 1.78 | 32.5 | 32 |
| 2 | 0 | 80 | 30 | 700 | - | 5.26 | 14.8 | 35 |
| 3 | 10 | 80 | 40 | 700 | - | 1.12 | 33.2 | 33 |
| 4 | 0 | 40 | 30 | 740 | - | 5.02 | 15.3 | 34 |
| 5 | 10 | 40 | 40 | 740 | - | 0.97 | 32.3 | 31 |
| 6 | 15 | 40 | 50 | 740 | 32 | 0.78 | 39.8 | 33 |
| 7 | 10 | 40 | 40 | 740 | 35 | 0.85 | 34.3 | 32 |

MULTILAYER CERAMIC ELECTRONIC COMPONENT

TECHNICAL FIELD

The present invention relates to a multilayer ceramic electronic component, such as a multilayer chip varistor.

BACKGROUND OF THE INVENTION

Semiconductor devices, such as ICs and LSIs, have been often used for providing electronic apparatuses with a high versatility and a small size. Such semiconductor devices, however, exhibits small resistance to abnormal voltages, produced due to, for example, noise, pulses and static electricity.

In order to increase the resistance to the abnormal voltages, multilayer ceramic electronic components, such as multilayer chip varistors, are used. Such semiconductor devices have had high performance and high operation speeds, and accordingly, had small resistance to abnormal voltages. Accordingly, protecting device, such as varistors having low varistor voltages, has been required.

Electric signals of these electronic apparatuses have frequencies of several MHz order. Varistors having small capacitances has been required to being prevented from influencing waveforms of the signals having such high frequencies.

Japanese Patent Laid-Open Publication No. 11-3809A discloses a varistor having a small capacitance. The varistor includes a varistor coating layer and a support layer with a low dielectric constant for supporting the varistor coating layer.

When the varistor coating layer is sintered unitarily with a ceramic layer functioning as the support layer made of material different from that of the varistor coating layer, a defect may be produced at the interface between the varistor coating layer and the ceramic layer, thereby reducing reliability of a chip varistor. During a firing process, additives, such as $Bi_2O_3$ and $Sb_2O_3$, with a low melting point included in the varistor coating layer may diffuse in the ceramic layer, accordingly reducing characteristics of the varistor coating layer as a varistor.

SUMMARY OF THE INVENTION

A multilayer ceramic electronic component includes a multilayer body, a first internal electrode provided in the multilayer body, and a second internal electrode provided in the multilayer body and facing the first internal electrode. The multilayer body includes a first ceramic layer, a second ceramic layer provided on a first surface of the first ceramic layer, and a third ceramic layer provided on a second surface of the first ceramic layer opposite to the first surface. The first and second internal electrodes are connected to the first ceramic layer. The first ceramic layer contains mainly ZnO and 0 to 15 mol % of $SiO_2$. The second ceramic layer contains mainly ZnO and 15 to 50 mol % of $SiO_2$. The third ceramic layer contains mainly ZnO and 15 to 50 mol % of $SiO_2$;

The multilayer ceramic component has a low varistor voltage and a small capacitance.

BRIEF DESCRIPTION OF THE DRAWINGS

FIG. 6 shows measurement data of samples of the multilayer ceramic electronic components in accordance with Embodiments 1 to 3.

REFERENCE NUMERALS

10 Multilayer Chip Varistor (Multilayer Ceramic Electronic Component)
11 Multilayer Body
12A Internal Electrode (First Internal Electrode)
12B Internal Electrode (Second Internal Electrode)
13 Ceramic Layer (First Ceramic Layer)
13A Surface of Ceramic Layer (First Surface)
13B Surface of Ceramic Layer (Second Surface)
14 Ceramic Layer (Second Ceramic Layer)
114 Ceramic Layer (Third Ceramic Layer)
16 Film
20 Multilayer Chip Varistor (Multilayer Ceramic Electronic Component)
21 Multilayer Body
22 Multilayer Chip Varistor (Multilayer Ceramic Electronic Component)
23 Multilayer Body

DETAILED DESCRIPTION OF THE PREFERRED EMBODIMENTS

Exemplary Embodiment 1

Figure 1:
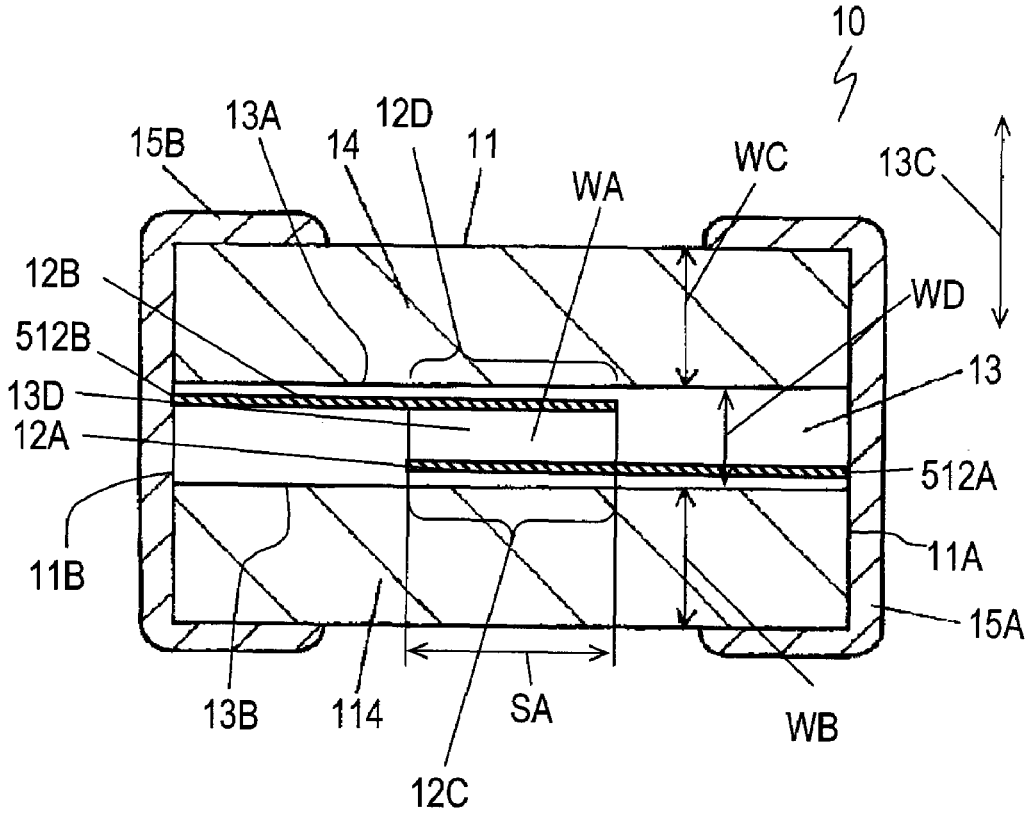
FIG. 1 is a sectional view of a multilayer ceramic electronic component in accordance with Exemplary Embodiment 1 of the present invention.

FIG. 1 shows a sectional view of multilayer chip varistor 10, a multilayer ceramic electronic component, according to Exemplary Embodiment 1 of the present invention. Varistor 10 includes multilayer body 11, internal electrodes 12A and 12B, and external electrodes 15A and 15B. Multilayer body 11 includes ceramic layers 13, 14, and 114. Ceramic layer 13 has surface 13A and surface 13B opposite to surface 13A in direction 13C. Ceramic layer 14 is provided on surface 13A of ceramic layer 13. Ceramic layer 114 is provided on surface 13B of ceramic layer 13. Multilayer body 11 has edge surface 11A and edge surface 11B opposite to edge surface 11A. Internal electrodes 12A and 12B are embedded in ceramic layer 13, are connected to ceramic layer 13, and face each other in direction 13C. Ends 512A and 512B of internal electrodes 12A and 12B expose at edge surfaces 11A and 11B of multilayer body 11, respectively. Ends 512A and 512B of internal electrodes 12A and 12B are connected to external electrodes 15A and 15B formed on edge surfaces 11A and 11B, respectively. Ceramic layers 14 and 114 have thicknesses WA and WC, respectively.

A method of manufacturing multilayer chip varistor 10 will be described below.

Varistor material is prepared by mixing ZnO as main component, $SiO_2$ as silicon compound, and at least one of $Bi_2O_3$, $Co_3O_4$, $MnO_2$, and $Sb_2O_3$ as additive. The varistor material is then pulverized. Polyvinylbutyral resin as organic binder, normal butyl acetate as solvent, and benzylbutylphthalate as a plasticizer are added to the pulverized varistor material to provide slurry. The slurry is formed by, e.g. a doctor blade method to provide plural first ceramic green sheets which are to be ceramic layer 13.

Similarly, another slurry is prepared by using varistor material including a concentration of $SiO_2$ different from that of the variator material used for the ceramic green sheets to be ceramic layer 13. This slurry is formed by, e.g. a doctor blade method to provide plural second ceramic green sheets. A predetermined number of the second ceramic sheets are attacked to provide ceramic layers 14 and 114 having predetermined thicknesses.

Pt powder as conductive metal powder, polyvinylbutyral resin as organic binder, normal butyl acetate as solvent, and benzylbutylphthalate as plasticizer are mixed with, e.g. a roll mill to provide metallic paste for making internal electrodes 12A and 12B.

A first ceramic green sheet is stacked on ceramic layer 14. Then, the metallic paste is applied onto the stacked first ceramic green sheet to form internal electrode 12B having a predetermined shape.

Another first ceramic green sheet is stacked on a surface of the green sheet having internal electrode 12B formed thereon. Then, the metallic paste is applied onto another first ceramic green sheet to form internal electrode 12A having a predetermined shape.

Internal electrodes 12A and 12B face each other across another first ceramic green sheet. Internal electrodes 12A and 12B partly faces each other, so that internal electrodes 12A and 12B are connected to external electrodes 15A and 15B, respectively.

Then, a further first ceramic green sheet is stacked on a surface of the first ceramic green sheet having internal electrode 12B formed thereon. Then, a predetermined number of the second ceramic green sheets are stacked on the further first ceramic green sheet to provide an unsintered multilayer body. The unsintered multilayer body is pressed to bond layers of the multilayer body, and is cut to have a predetermined shape to provide an unsintered body which is to be multilayer body 11.

This unsintered body is put into a sheath and fired at a temperature which rises from 1000° C. to 1400° C. at a temperature rising rate of 200° C./h, kept at the maximum temperature for two hours, and falling at a temperature falling rate of 100° C./h, thus providing a sintered body After the sintering, the sintered body is chamfered to allow ends 512A and 512B of internal electrodes 12A and 12B to expose at edge surfaces 11A and 11B, respectively. Then, external electrodes 15A and 15B mainly containing Ag are formed on edge surfaces 11A and 11B, respectively, thus providing multilayer chip varistor 10.

A method of measuring a varistor voltage, a voltage non-linear coefficient α, and a capacitance of multilayer chip varistor 10 will be described below. A direct-current (DC) constant current source was connected between external electrodes 15A and 15B so as to cause an electric current of 1 mA to flow, and a voltage $V_{1mA}$ between external electrodes 15A and 15B was measured as the varistor voltage. A current at this measuring was $I_{1mA}$ (i.e., 1 mA). When the current source caused a current 0.01 mA to flow, a voltage $V_{0.01mA}$ was measured. A current at this measuring was $I_{0.01mA}$ (i.e., 0.01 mA). The voltage non-linear coefficient α is calculated by the following formula:

$$\alpha=\{\log(I_{1mA})-\log(I_{0.01mA})\}/\{\log(V_{1mA})-\log(V_{0.01mA})\}$$

A sample having a large voltage non-linear coefficient α has preferable characteristics as a varistor. The coefficient α is preferably not smaller than 30.

The capacitance was measured with a digital LCR meter under the condition that an ambient temperature was 25° C., the voltage for the measuring was 1V and has a frequency of 1 MHz.

An appropriate range of the concentration of $SiO_2$ in ceramic layers 13, 14, and 114 of multilayer chip varistor 10 will be described below.

The relationship among the concentration of $SiO_2$, the voltage non-linear coefficient α, and the capacitance will be explained.

Figure 3:
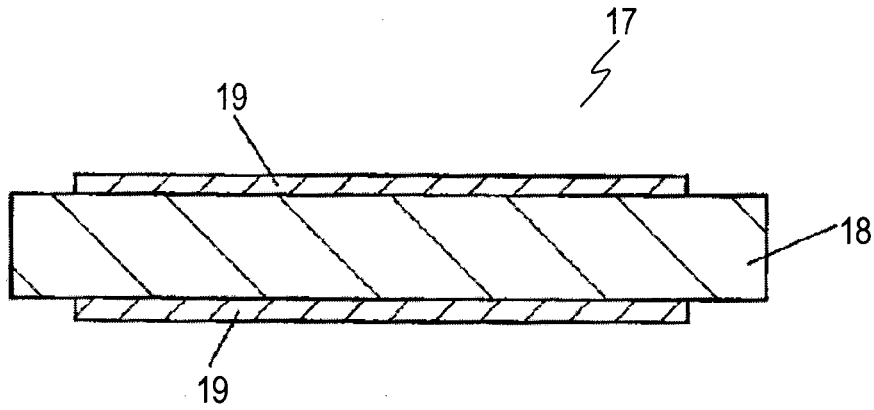
FIG. 3 is a sectional view of a disc varistor element.

The varistor material contains the additive, 0.5 mol % of $Bi_2O_3$, 0.5 mol % of $Co_3O_4$, 0.5 mol % of $MnO_2$, and 1.0 mol % of $Sb_2O_3$. FIG. 3 is a sectional view of disc varistor element 17 as a sample for evaluating characteristics of the varistor material. The samples including concentrations of $SiO_2$ different from each other are formed to have a disc shape having an outer diameter of 15 mm and a thickness of 1.2 mm, and then, fired at 1100° C. for two hours, thereby providing sintered body 18 having an outer diameter of 13 mm and a thickness of 1.0 mm. Then, electrodes 19 having an outer diameter of 10 mm are applied onto upper and lower surfaces of sintered body 18 and fired, thereby providing disc varistor element 17. Disc varistor element 18 was measured by the method similar to that of the multilayer chip varistor. Thickness T of sintered body 18 and area S19 of electrode 19 were measured. Further, varistor voltage $V_{1mA}$/mm per thickness of 1 mm of the varistor material and dielectric constant εr calculated. Varistor voltage $V_{1mA}$/mm is obtained by dividing the varistor voltage of disc varistor element 17 by thickness T of sintered body 18. Disc varistor element 17 has capacitance C. The dielectric constant ε0 in vacuum is $8.854\times10^{-12}$ (F/m). Dielectric constant εr is calculated by the following formula:

$$\epsilon r=C\times T/(\epsilon 0\times S19)$$

Figure 2:
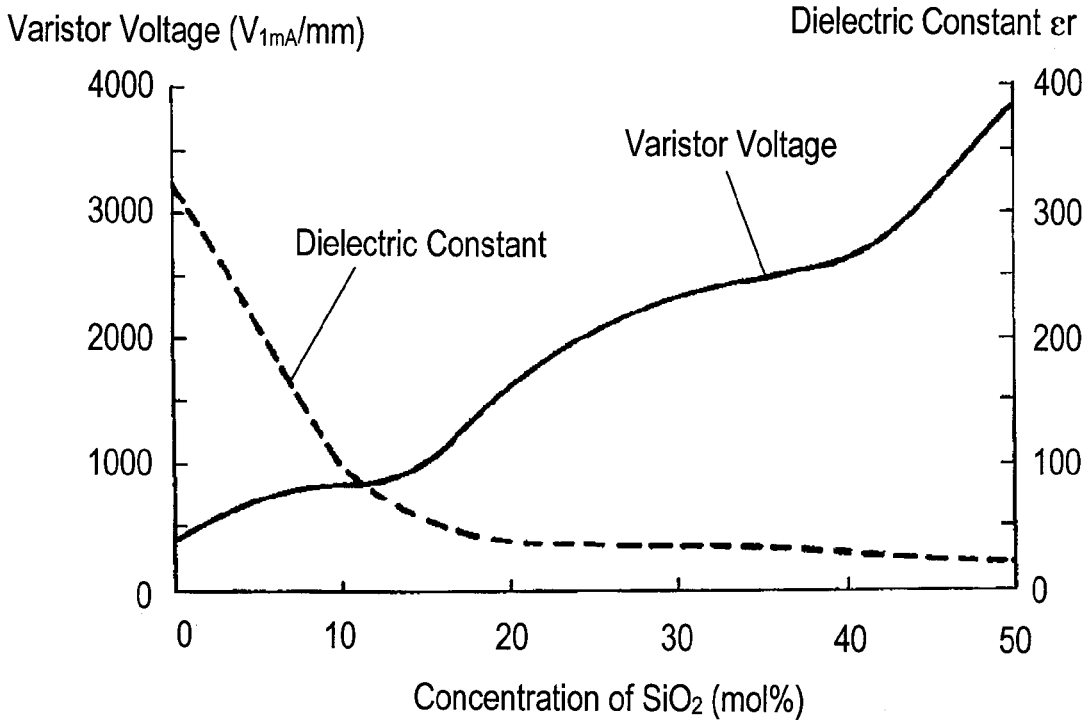
FIG. 2 shows the relation among the concentration of $SiO_2$ in varistor material, a varistor voltage and a dielectric constant.

FIG. 2 shows the relationship among the concentration of $SiO_2$ in the varistor material, varistor voltage $V_{1mA}$/mm, and dielectric constant εr.

The concentration of $SiO_2$ suitable for ceramic layer 13 will be explained with reference to FIG. 2. According to the increase of the concentration of $SiO_2$ in the varistor material, varistor voltage $V_{1mA}$/mm increases, and particularly, sharply increases upon the concentration of $SiO_2$ exceeding 15 mol %. Dielectric constant εr sharply decreases in the range of the concentration of $SiO_2$ from 0 to 10 mol %, and decreases more gradually than that of the range from 0 to 10 mol %.

Varistor voltage between external electrodes 15A and 15B of multilayer chip varistor 10 is in proportion to distance WA portion 13D of ceramic layer 13 placed between internal electrodes 12A and 12B. Thus, in order to provide the multilayer chip varistor with a low varistor voltage, distance WA between internal electrodes 12A and 12B is determined to be small. However, the reducing of distance WA reduces the volume of a portion for absorbing heat generated due to a surge current or static electricity.

In multilayer chip varistor 10, while distance WA between internal electrodes 12A and 12B is sufficiently long enough for maintaining the volume for absorbing the heat, the concentration of $SiO_2$ in ceramic layers 13, 14, and 114 is controlled to provide a small capacitance.

If the concentration of $SiO_2$ exceeds 15 mol %, varistor voltage $V_{1mA}$/mm exceeds 1000V/mm. In this case, varistor 10 may be broken easily by a surge current.

When surge current or static electricity is applied to multilayer body 11, ceramic layer 13 absorbs it. Therefore, the concentration of $SiO_2$ may range preferably from 0 to 15 mol %, more preferably from 3 to 13 mol % to provide a small capacitance and a low varistor voltage.

Next, the concentration of $SiO_2$ suitable for ceramic layers 14 and 114 will be explained with reference to FIG. 2. The capacitance between external electrodes 15A and 15B of multilayer chip varistor 10 is obtained as the sum of the capacitance appearing at portion 13D of ceramic layer 13 between internal electrodes 12A and 12B, the capacitance appearing outside portion 13D of ceramic layer 13, and the capacitance appearing at ceramic layer 14 and ceramic layer 114. Ceramic layers 13, 14, and 114 may preferably be made of varistor material having a low dielectric constant. However, as described above, since the concentration of $SiO_2$ ranges preferably from 0 to 15 mol % to provide a low varistor voltage, dielectric constant $\epsilon r$ of ceramic layer 13 is hardly smaller than 61, which is dielectric constant $\epsilon r$ at the concentration of $SiO_2$ of 15 mol %. In order to provide multilayer chip varistor 10 with a small capacitance, ceramic layers 14 and 114 are made of material having a dielectric constant smaller than that of ceramic layer 13 between internal electrodes 12A and 12B. As shown in FIG. 2, dielectric constant $\epsilon r$ is smaller than 61 while eth concentration of $SiO_2$ exceeds 15 mol %. That is, ceramic layers 14 and 114 may be made of material including more than 15 mol % of $SiO_2$, thereby providing chip varistor 10 with a small capacitance. However, the material including more than 50 mol % of $SiO_2$ is not suitable since the material cannot be sintered.

Samples 1 to 3 of multilayer chip varistor 10 having outer dimensions of 1.6 mm by 0.8 mm by 0.8 mm were prepared with using various varistor materials by the above manufacturing method. Ceramic layer 13 itself has thickness WD of 80 μm. The distance between internal electrodes 12A and 12B of the samples, i.e., thickness WA of ceramic layer 13 between internal electrodes 12A and 12B was 40 μm. Area SA of each of portions 12C and 12D where internal electrodes 12A and 12B overlap each other was measured 0.020 $mm^2$. In these samples, ceramic layers 13, 14, and 114 were bonded without visible borders and no structural defect. The difference of the concentration of the additives, such as $Bi_2O_3$ and $Sb_2O_3$ was small between ceramic layer 13 and ceramic layers 14 and 114. Therefore, diffusion of the additive does not provide influence, and accordingly providing chip varistor 10 with reliability.

FIG. 6 shows measurement results of voltage non-linear coefficient α and capacitances of samples 1 to 3. Sample 1 including ceramic layers 13 14, and 114 containing 10 mol % of $SiO_2$ has a capacitance of 1.78 pF and a varistor voltage of 32.5V. Sample 3 which includes ceramic layer 13 containing 1 mol % of $SiO_2$ and ceramic layers 14 and 114 containing 40 mol % of $SiO_2$ has a capacitance of 1.12 pF and a varistor voltage of 33.2V. Sample 3 preferably has a varistor voltage similar to that of sample 1 and a capacitance smaller than that of sample 1, and has a voltage non-linear constant α larger than 30. That is, this material provides multilayer chip varistor 10 having a capacitance smaller than that of sample 1 which includes ceramic layers 13, 14, and 114 containing the same concentration of $SiO_2$.

Exemplary Embodiment 2

Figure 4:
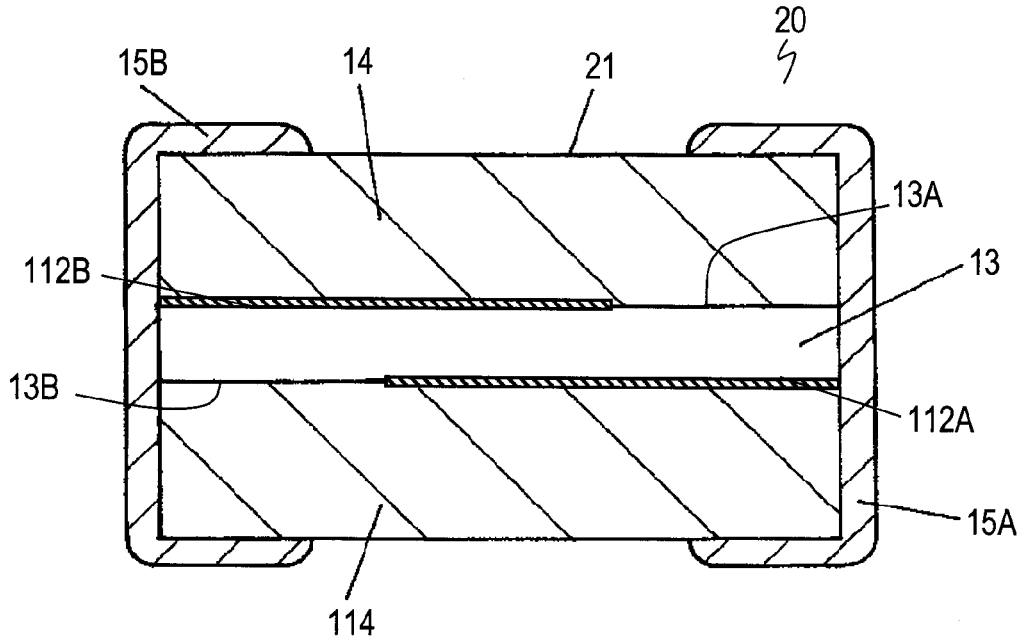
FIG. 4 is a sectional view of a multilayer ceramic electronic component in accordance with Exemplary Embodiment 2 of the invention.

FIG. 4 is a sectional view of multilayer chip varistor 20 in accordance with Exemplary Embodiment 2 of the invention. In varistor 20, components identical to those of multilayer chip varistor 10 shown in FIG. 1 according to Embodiment 1 are denoted by the same reference numerals, and their description will be omitted. Varistor 20 includes multilayer body 21 including ceramic layers 13, 14, and 114 instead of multilayer body 11 of varistor 10. Varister 20 includes internal electrodes 112A and 112B instead of internal electrodes 12A and 12B of varistor 10. Internal electrode 112B is provided on surface 13A of ceramic layer 13 between ceramic layers 13 and 14. Internal electrode 112A is provided on surface 13B of ceramic layer 13 between ceramic layers 13 and 114.

A method of manufacturing multilayer chip varistor 20 will be described below.

A predetermined number of the second ceramic green sheets used in varistor 10 so as to provide ceramic layer 14 having a predetermined thickness. Then, the metallic paste is applied onto ceramic layer 14 to form internal electrode 112B having a predetermined shape. Then, the first ceramic green sheet is stacked on a surface of ceramic layer 14 having internal electrode 112B formed thereon so as to form ceramic layer 13. Then, the metallic paste is applied onto ceramic layer 13 so as to form internal electrode 112A having a predetermined shape. Internal electrodes 112A and 112B partly overlap each other to be connected to external electrodes 15A and 15B, respectively.

Then, a predetermined number of the second ceramic green sheets are stacked on internal electrode 112A, thus providing an unsintered multilayer body. The unsintered multilayer body is pressed to bond the layers of the multilayer body to each other, and is cut to have a predetermined shape, thereby providing an unsintered body which is to be multilayer body 21.

The unsintered body is fired similarly to chip varistor 10 according to Embodiment 1, and then, external electrodes 15A and 15B are formed on the multilayer body, thereby preparing samples 4 and 5 of multilayer chip varistor 20 shown in FIG. 6. Cerarmic layer 13 of samples 4 and 5 has a thickness of 40 μm, which is smaller than that of samples 1 to 3, since ceramic layer 13 of samples 4 and 5 has no portion placed outside internal electrodes 112A and 112B. FIG. 6 shows characteristics of samples 4 and 5 measured similarly to those of samples 1 to 3.

In multilayer chip varistor 20, internal electrode 112A is provided at the interface between ceramic layers 13 and 114 while internal electrode 112B is provided at the interface between ceramic layers 13 and 14. Varistor 10 according to Embodiment 1 includes portions of ceramic layer 13 with a high dielectric constant outside internal electrodes 12A and 12B. In chip varistor 20, however, these portions with the high dielectric constant are replaced by ceramic layers 14 and 114 having a dielectric constant lower than that of ceramic layer 13. This structure allows a capacitance between external electrodes 15A and 15B to be smaller than that of varistor 10. Sample 5 has a capacitance of 0.97 pF and a varistor voltage of 32.3V, thus providing multilayer chip varistor 20 with a smaller capacitance.

Exemplary Embodiment 3

Figure 5:
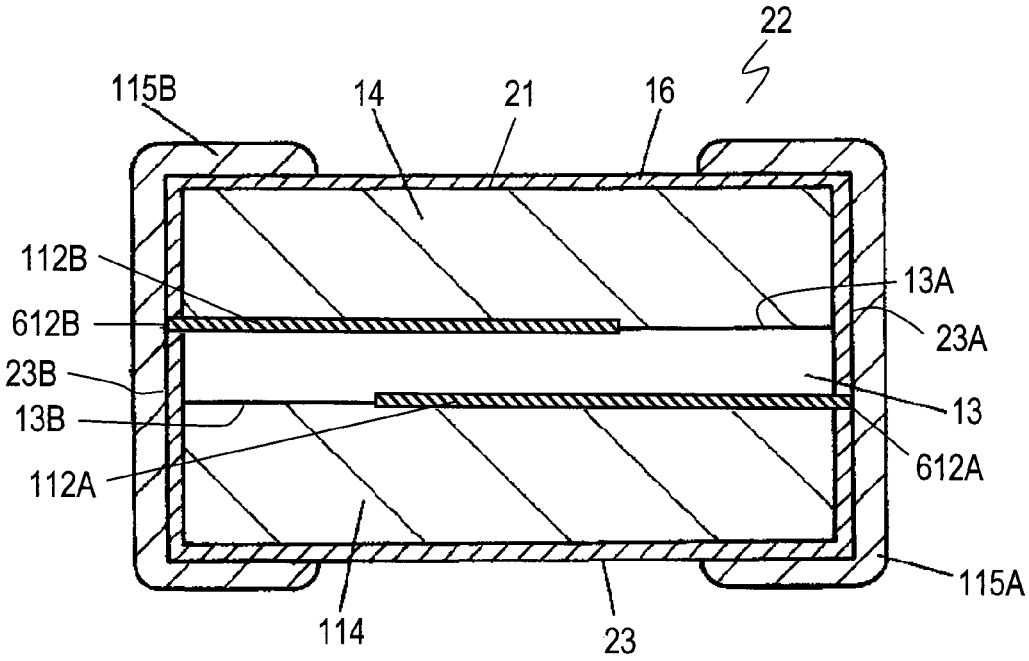
FIG. 5 is a sectional view of a multilayer ceramic electronic component in accordance with Exemplary Embodiment 3 of the invention.

FIG. 5 is a sectional view of multilayer chip varistor 22 in accordance with Exemplary Embodiment 3. In varistor 22, components identical to those of multilayer chip varistor 20 shown in FIG. 4 according to Embodiment 2 are denoted by the same reference numerals, and their description will be omitted. Varistor 22 includes multilayer body 21 including ceramic layers 13, 14, and 114. Multilayer body 21 is covered with film 16 made of Zn—Si—O-based compound containing mainly $Zn_2SiO_4$.

The Zn—Si—O-based compound contains mainly non-stoichiometric compound consisting of Zn, Si, and O (i.e., the ratio of Zn:Si:O is not equal to 2:1:4), and further contains Bi and Sb. For example, this non-stoichiometric compound is $Zn_xSi_yO_z$, $Zn_xSi_yBi_mO_z$, or $Zn_xSi_ySb_nO_z$, where, x, y, z, m, and n are natural numbers.

A method of manufacturing multilayer chip varistor 22 will be described below:

An unsintered body which is to be multilayer body 21 by a method similarly to that of manufacturing varistor 20 according to Embodiment 2. The unsintered body is heated in a furnace so as to remove the binder from the unsintered body. Then, the unsintered body are put into a cylindrical sheath together with alumina, and fired while the cylindrical sheath rotates. The unsintered body is heated in the sheath at a temperature rising up to 1000 to 1400° C. at a temperature rising rate of 200° C./h, kept at the maximum temperature for two hours, and then, falling at a temperature falling rate of 100° C./h so as to fire the unsintered body. This firing process provide multilayer body 23 covered with film 16 made of the Zn—Si—O-based compound containing mainly $Zn_2SiO_4$.

After the firing, multilayer body 23 is cleaned to remove unnecessary substance, such as alumina powder, attached onto a surface of multilayer body 23, and then is dried. Then, multilayer body 23 is chamfered so that ends 612A and 612B of internal electrodes 112A and 112B expose at edge surfaces 23A and 23B, respectively. External electrodes 115A and 115B containing mainly Ag are formed by firing on edge surfaces 23A and 23B having attends 612A and 612B of internal electrodes 112A and 112B exposing thereon, respectively, thereby providing multilayer chip varistor 22.

In multilayer chip varistor 22, multilayer body 23 is covered with film 16 made of the Zn—Si—O-based compound consisting mainly of $Zn_2SiO_4$ with an extremely low dielectric constant. Film 16 is located between external electrode 15A and ceramic layer 13, between external electrode 15B and ceramic layer 13, between external electrode 115A and ceramic layer 14, between external electrode 115B and ceramic layer 14, between external electrodes 15A and ceramic layer 114, and between external electrode 15B and ceramic layer 114. In this structure, both ends of ceramic layers 13, 14 and 114 are sandwiched between film 16 of the Zn—Si—O-based compound having the extremely low dielectric constant, hence allowing members with dielectric constant different from each other to be connected in series and in parallel to each other between external electrodes 115A and 115B. Specifically, film 16 is connected in series with ceramic layer 14 (13, 114) between external electrodes 115A and 115B, thus providing a series connection assembly. In this assembly, external electrode 115A, film 16, ceramic layer 14 (13, 114), film 16, and external electrode 115B are connected in series in this order. Film 16 is connected in parallel with the series connection assembly between external electrodes 115A and 115B. This structure provides varistror 22 with a capacitance smaller than that of varistor 20 including ceramic layers 13, 14, and 114 are directly connected with external electrodes 115A and 115B.

Samples 6 and 7 of multilayer chip varistor 22 having an outer dimensions of 1.6 mm by 0.8 mm by 0.8 mm were prepared. FIG. 6 shows characteristics of sample 7 measured similarly to samples 1 to 3. This sample has a capacitance of 0.85 pF and a varistor voltage of 34.4V.

According to Embodiments 1 to 3, ceramic layers 14 and 114 arranged across ceramic layer 13 have the same concentration of $SiO_2$. The concentration of $SiO_2$ in ceramic layer 14 may be different from that of ceramic layer 114 as long as these concentrations are larger than that of ceramic layer 13. According to Embodiments 1 to 3, each of ceramic layers 14 and 114 contain $SiO_2$ at a uniform concentration. The concentration of $SiO_2$ may be different partly in each of the layers.

Ceramic layers 14 and 114 of multilayer bodies 11 and 21 shown in FIGS. 1, 4, and 5 have thicknesses identical to each other, however, may have thicknesses different from each other. According to Embodiments 1 to 3, Pt is used as materials of internal electrodes 12A, 12B, 112A, and 112B, however, other conductive metals, such as Ag and Pd, may be used, providing the same effects.

Each of multilayer chip varistors 10, 20, and 22 according to Embodiments 1 to 3 includes two internal electrodes, however, may include three or more internal electrodes, providing the same effects.

INDUSTRIAL APPLICABILITY

A multilayer ceramic component according to the present invention has a low varistor voltage and a small capacitance, hence being useful to protect a semiconductor device used with a high-speed signal line from static electricity.

The invention claimed is:

1. A multilayer ceramic electronic component comprising:

a multilayer body including a first ceramic layer having a first surface and a second surface opposite to the first surface, the first ceramic layer containing mainly ZnO and 0 to 15 mol % of $SiO_2$, a second ceramic layer provided on the first surface of the first ceramic layer, the second ceramic layer containing mainly ZnO and 15 to 50 mol % of $SiO_2$, and a third ceramic layer provided on the second surface of the first ceramic layer, the third ceramic layer containing mainly ZnO and 15 to 50 mol % of $SiO_2$;

a first internal electrode provided in the multilayer body and connected to the first ceramic layer; and a second internal electrode provided in the multilayer body and connected to the first ceramic layer, the second internal electrode facing the first internal electrode.

2. The multilayer ceramic electronic component of claim 1, wherein the first internal electrode and the second internal electrode are provided in the first ceramic layer.

3. The multilayer ceramic electronic component of claim 1, wherein the first internal electrode is provided on the first surface of the first ceramic layer between the first ceramic layer and the second ceramic layer, and the second internal electrode is provided on the second surface of the first ceramic layer between the first ceramic layer and the third ceramic layer.

4. The multilayer ceramic electronic component of claim 1, further includes a film made of Zn—Si—O-based compound containing mainly $Zn_2SiO_4$.

5. The multilayer ceramic electronic component of claim 1, wherein the first ceramic layer further contains additive.

6. The multilayer ceramic electronic component of claim 1, wherein the second ceramic layer further contains additive.

7. The multilayer ceramic electronic component of claim 1, wherein the third ceramic layer further contains additive.

8. The multilayer ceramic electronic component according to any one of claims 5 to 7, wherein the additive is at least one of $Bi_2O_3$, $Co_3O_4$, $MnO_2$, and $Sb_2O_3$.

* * * * *